US006732718B2

(12) United States Patent
Kano et al.

(10) Patent No.: US 6,732,718 B2
(45) Date of Patent: May 11, 2004

(54) EVAPORATIVE EMISSION CONTROL APPARATUS

(75) Inventors: Masao Kano, Gamagori (JP); Yasunori Kobayashi, Toyohashi (JP); Hideaki Itakura, Okazaki (JP); Noriyasu Amano, Gamagori (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 36 days.

(21) Appl. No.: 10/084,979

(22) Filed: Mar. 1, 2002

(65) Prior Publication Data

US 2002/0121270 A1 Sep. 5, 2002

(30) Foreign Application Priority Data

Mar. 2, 2001 (JP) ..... 2001-058972

(51) Int. Cl.[7] ..... F02M 25/08
(52) U.S. Cl. ..... 123/518; 123/519; 123/520
(58) Field of Search ..... 123/516, 518, 123/519, 520, 533

(56) References Cited

U.S. PATENT DOCUMENTS 5,273,020 A * 12/1993 Hayami ..... 123/520
5,349,935 A * 9/1994 Mezger et al. ..... 123/520
5,635,630 A * 6/1997 Dawson et al. ..... 123/520
5,730,107 A * 3/1998 Blumenstock ..... 123/520
5,863,025 A 1/1999 Noya ..... 251/129.17
5,881,700 A * 3/1999 Gras et al. ..... 123/520
5,975,062 A 11/1999 Bonse et al. ..... 123/519
6,138,644 A * 10/2000 Saruwatari et al. ..... 123/520
6,196,202 B1 * 3/2001 Busato et al. ..... 123/520
6,247,458 B1 * 6/2001 Heinemann et al. ..... 123/520
6,412,277 B2 * 7/2002 Hagen et al. ..... 123/520

* cited by examiner

*Primary Examiner*—Thomas N. Moulis
(74) *Attorney, Agent, or Firm*—Nixon & Vanderhye P.C.

(57) ABSTRACT

In a double-acting diaphragm pump, a diaphragm is provided to divide a pump body into two pump chambers. An electromagnetic-type reciprocating actuator is provided in a housing hermetically integrated with the pump body. Different from an electric-type pump, the actuator is integrally mounted on the double-acting diaphragm pump and an entire system is hermetically sealed. Therefore, even if the diaphragm is torn, fuel vapor is prevented from leaking outside. Additionally, four check valves are provided to control the discharge of vapor from a canister side to an engine side. These check valves may employ a reed to control vapor flow or a spring and plate to control flow. In addition, since the pump may be a double-acting type, a large discharge volume is obtained and the pump can be made smaller. The pump may also be a non double-acting type.

34 Claims, 5 Drawing Sheets

EVAPORATIVE EMISSION CONTROL APPARATUS

CROSS REFERENCE TO RELATED APPLICATION

This application is based on and incorporates herein by reference Japanese Patent Application No. 2001-58972 filed on Mar. 2, 2001.

BACKGROUND OF THE INVENTION

1. Field of the Invention

The present invention relates to an evaporative emission control apparatus for treating fuel vapor evaporated within a fuel tank connected to an internal combustion engine so that the vapor is not released to the atmosphere.

2. Description of Related Art

In general, a vehicle evaporative emission control apparatus is provided to an internal combustion engine in order to prevent fuel vapor evaporated within the fuel tank from being released to the atmosphere. In this apparatus, a charcoal canister (hereafter, canister) is provided as a fuel vapor adsorbing means. The fuel vapor evaporated in the fuel tank is temporarily adsorbed by an adsorbent such as activated charcoal powder within the canister. When the inside of an air intake pipe is negatively pressurized during engine operation, outside air is drawn into and passes through the canister to remove the adsorbed fuel vapor from the adsorbent. Then, the drawn air and the removed fuel vapor are fed into combustion chambers of cylinders through the air intake pipe and combusted.

In recent years, however, vehicles with gasoline-injection engines have increased and gasoline-injection engines are being operated at high air-fuel ratios which are, from a theoretical point of view, lean fuel mixtures. In the gasoline-injection engine, the negative intake pressure tends to decrease in accordance with an increase in the air-fuel ratio, that is, in accordance with using a lean mixture. Therefore, it is difficult to ensure the predetermined intake negative pressure for purging the fuel vapor.

Furthermore, vehicles utilizing hybrid driving technology (i.e. "hybrids") are increasing. The internal combustion engines of these vehicles boast improved fuel economy with an increase in combustion efficiency. These engines are driven at high speeds and in a highly loaded and maximized state in which a throttle valve is largely opened. This causes pressure variations within the intake system. Therefore, similar to the gasoline-injection engines on non-hybrid vehicles, it is difficult to ensure a predetermined intake negative pressure for purging the fuel vapor.

To solve the above problem, in U.S. Pat. No. 5,975,062, an electric air pump operated by an electric control unit is provided on a purge pipe communicating with a canister and an air intake pipe of an internal combustion engine. Accordingly, even when the negative intake pressure of the engine is low, purging air including fuel vapor removed from the canister is forcefully drawn and fed into the air intake pipe by operation of the electric air pump.

In the above electric air pump, however, it is necessary to prevent fuel vapor from leaking into the motor and to the atmosphere from a sealing portion around a shaft that connects the air pump and the motor. Further, since this electric air pump uses an air-fuel mixture, an explosion may occur if the fuel vapor leaks into the motor and is ignited due to sparks within or from the motor. Therefore, it is necessary to use a motor having an expensive explosion-resistant construction, such as a brushless motor, to prevent an explosion.

SUMMARY OF THE INVENTION

The present invention is made in view of the above problem, and it is an object to provide an evaporative emission control apparatus in which electric power consumption of a pump is reduced, the pump being used as a drawing means for removing fuel vapor from a fuel vapor adsorbing means such as a canister and for purging the fuel vapor. Also, leakage of the fuel vapor form the pump, due to pump damage, is eliminated which will increase safety and reduce air pollution. This is accomplished without necessitating a motor having an explosion-resistant construction. Further, a purge amount is easily controlled. It is another object to provide an evaporative emission control apparatus that can diagnose problems in a system without providing an optional problem checking system.

According to one embodiment of the present invention, an evaporative emission control apparatus is provided as a double-acting diaphragm pump used as a drawing means for drawing fuel vapor. In this pump, a chamber is provided on each side of a diaphragm and each is used as a pump chamber. Also, at each end of the pump, two check valves are utilized to control fluid flow into and from the pump chambers. Therefore, the pump can restrict breathing noises from being released outside the pump and also, discharge pressure surges can be reduced. Further, an amount of fluid discharged from the pump can be increased.

The evaporative emission control apparatus of the present invention is suitably used on an internal combustion engine mounted in a vehicle and the like. In this case, an end of a purge pipe is connected to an air intake pipe of the engine, so that combustion chambers in the engine are suitably used as a fuel vapor treating means.

In an embodiment of the evaporative emission control apparatus of the present invention, an actuating means of the double-acting diaphragm pump, a moving core for driving the diaphragm, and a solenoid coil for reciprocating the moving core, and the like, are provided in a pump housing that is hermetically integrated with a pump body. This prevents any pump portion from communicating outside of the pump, for instance, in other types of pumps that may use abrasion of sliding sealing surfaces. Accordingly, the fuel vapor is restricted from leaking outside of the actuating means. The solenoid coil generates electromagnetic power when AC voltage or pulse voltage is applied which causes the moving core to reciprocate. Therefore, power utilization (efficiency) is increased as compared to a case in which rotation is transformed into reciprocation. Additionally, there is no pump portion generating sparks. Therefore, an explosion will not occur even if fuel vapor leaks into the actuating means. Further, since its structure is simple, manufacturing costs are reduced.

The solenoid coil and the like are used as the actuating means of the double-acting diaphragm pump. A discharging amount discharged from the double-acting diaphragm pump per unit time is changed by controlling at least one of voltage, current and frequency supplied to the solenoid coil. Therefore, a purging amount of the fuel vapor, purged from the fuel vapor adsorbing means, can be easily controlled. Further, when the moving core is made of a permanent magnet, the diaphragm may be lifted to its maximum height, thereby increasing the discharge amount.

Check valves, which are automatically opened/closed by a pressure difference between an upstream side and a downstream side of the check valves, are provided at both inlet ports and outlet ports of two pump chambers of the double-acting diaphragm pump and function as pumps themselves. Reed valves can be used in place of the check valves. Also, reed valves can be provided on valve bodies of the check valves. These reed-type check valves are shaped to be open when a pressure difference does not exist between the upstream side and the downstream side which occurs when the pump stops. Therefore, the double-acting diaphragm pump fluidly communicates internally. Accordingly, it is possible to leak test an entire system of the evaporative emission control apparatus including the inside of the pump. A leak test checks the "leak-tightness" of the pump system. Alternatively, a bypass pipe for connecting an upstream side purge pipe of the pump and at least one of two pump chambers is provided to leak test the system. Further, an open/close valve is provided between the pump and the fuel vapor adsorbing means.

In an embodiment of the evaporative emission control apparatus of the present invention, in order to leak-check the system, an open/close valve is provided at an air intake side of the fuel vapor adsorbing means. Further, a pressure detecting means is provided to detect pressure in the fuel vapor adsorbing means, a fuel vapor-generating source connected to the fuel vapor adsorbing means, and the double-acting diaphragm pump. In this case, a general canister open/close valve may be used for the open/close valve provided at the air intake side. Also, a general pressure sensor provided in a fuel tank and the like are used as the pressure detecting means. Therefore, it may be unnecessary to provide optional valves and pressure sensors for the leak test.

In another embodiment of the present invention, a diaphragm pump does not have to be of the double-acting type. Therefore, it is yet another object to provide a diaphragm pump that is not of the double-acting type. A single-acting diaphragm pump is an example of a non double-acting diaphragm pump.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF PREFERRED EMBODIMENTS

The following description of the preferred embodiments is merely exemplary in nature and is in no way intended to limit the invention, its application, or uses. In the description, structural portions that are substantially the same are denoted by like reference symbols, so explanations of those portions may not be repeated in subsequent embodiments.

First Embodiment

Figure 1:
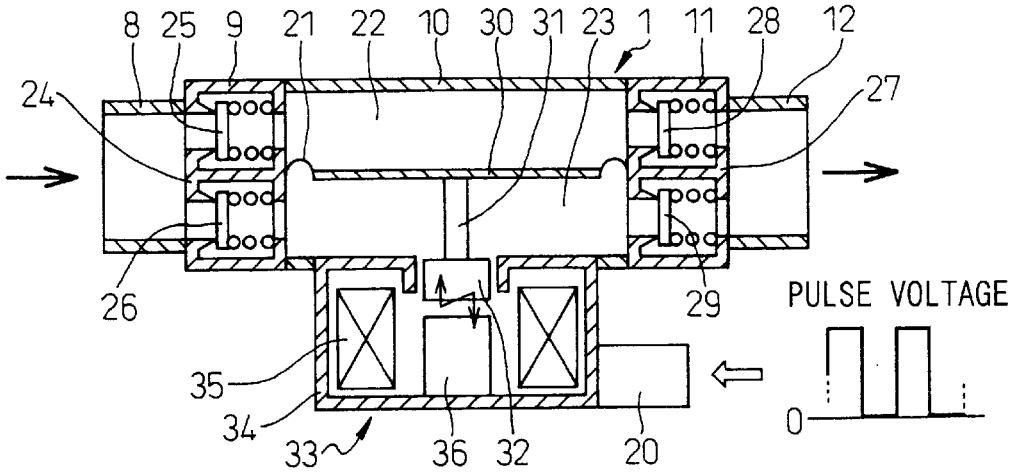
FIG. 1 is a cross-sectional view of a diaphragm pump of a first embodiment of the present invention.
Figure 2:
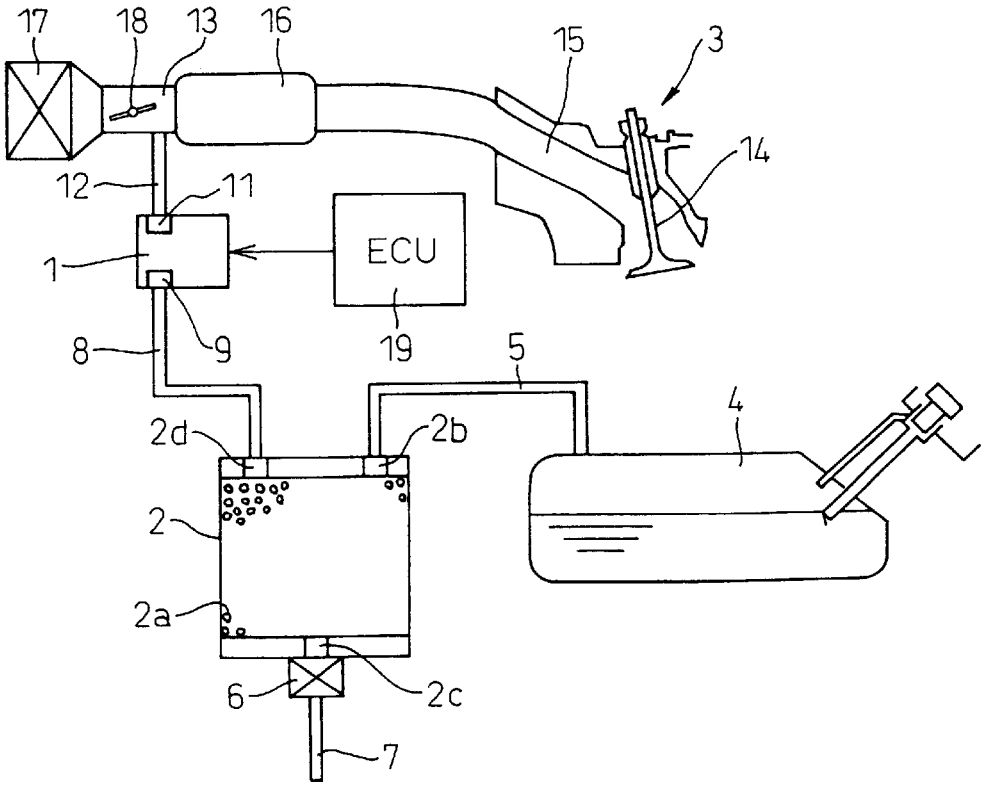
FIG. 2 is a diagram of a structural view of an evaporative emission control apparatus of the first embodiment of the present invention.

A first embodiment of the present invention will be described with reference to FIGS. 1 and 2. A double-acting diaphragm pump 1 shown in FIG. 1 is a main part of an evaporative emission control apparatus of the present invention. A system of the apparatus is shown in FIG. 2. In FIG. 2, a canister (charcoal canister) 2 includes adsorbent 2*a* such as activated carbon powder for temporarily adsorbing fuel vapor. An end of a fuel vapor pipe 5 is connected into an upper space of a fuel tank 4 for supplying fuel to an internal combustion engine 3. The canister 2 has a fuel vapor intake port 2*b* and the other end of the fuel vapor pipe 5 is connected to the fuel vapor intake port 2*b*. Further, the canister 2 has an air intake port 2*c* for introducing air for purging and a purge port 2*d* at an opposite side of the air intake port 2*c*. The air intake port 2*c* communicates with outside air through an open/close valve 6 which is controlled by a control device and the like and an air pipe 7. The purge port 2*d* communicates with a pump inlet 9 of the diaphragm pump 1 through a purge pipe 8.

Although a detailed structure of the double-acting diaphragm pump 1 will be described later, a body 10 of the double-acting diaphragm pump 1 has a pump outlet 11 at the opposite end of the pump inlet 9. As shown in FIG. 2, the pump outlet 11 communicates with an air intake pipe 13 of the internal combustion engine 3 through a purge pipe 12. An air intake valve 14 of the engine 3 fluidly communicates with an air intake port 15, which is connected to a surge tank 16 (this arrangement is commonly provided for a plurality of cylinders). An air cleaner 17 is connected to the surge tank 16 by the air intake pipe 13 which contains a throttle valve 18. Electric power for operating the diaphragm pump 1 is generated by the internal combustion engine 3 or originates from an unillustrated battery or the like. The electric power is controlled in an electric control unit (ECU) 19 including a driving unit to have a predetermined electric current and current type (pulse-type in the first embodiment), and is supplied to a terminal 20 of the diaphragm pump 1. The ECU operates the above-mentioned open/close valve 6.

The structure of the double-acting diaphragm pump 1 of the first embodiment is described in detail with reference to FIG. 1. The pump inlet 9 is provided opposite to the pump outlet 11 in the body 10 of the diaphragm pump 1. The pump body 10 has a cylindrical shape having an axial line coincident with the direction of fluid flow as shown in FIG. 1, but may have other shapes. An inner space of the body 10 is divided into a first pump chamber 22 and a second pump chamber 23 with a diaphragm 21 having flexibility. Further, the pump inlet 9 and the pump outlet 11 are respectively divided into top and bottom portions to correspond to the pump chambers 22 and 23.

Specifically, the pump inlet 9 is divided into two inlets with a partition wall 24, and check valves 25 and 26 as inlet valves are respectively provided therein. Each of the check valves 25 and 26 has a valve plate that can close a valve port from a downstream side (pump chambers 22 and 23 side) and a coil spring that biases the valve plate toward the valve port. Similarly, the pump outlet 11 is divided into two outlets with a partition wall 27, and check valves 28 and 29 as delivery valves are respectively provided therein. Each of the check valves 28 and 29 has a valve plate that can close a valve port from the downstream side (a purge pipe 12 side) and a coil spring that biases the valve plate toward the valve port.

The diaphragm 21 is disc-shaped and the periphery thereof is fixed on the cylindrical inner wall of the body 10. At the pump inlet 9 and the pump outlet 11, the diaphragm 21 is fixed on the inner wall at parts corresponding to the partition walls 24 and 27. The partition walls 24 and 27 are extendedly provided from the cylindrical inner wall of the body 10 in a radial fashion. That is, partition wall 24 divides check valves 25 and 26 and partition wall 27 divides check valve 28 and 29. Metallic plates 30 are provided on surfaces of the diaphragm 21 to sandwich the middle of the diaphragm 21 from the top (first pump chamber 22) and the bottom (second pump chamber 23). Further, a drive shaft 31 is fitted to the metallic plate 30 as shown in FIG. 1. A moving core 32 is made of a magnetic material such as iron, and attached to the bottom end of the drive shaft 31, that is, the end closest to the core 36.

An actuator 33 is provided at the bottom (with reference to FIG. 1) of the body 10. The actuator 33 has a housing 34 that is air-tight and integrated with the body 10. A solenoid coil 35 is fixed inside the housing 34. A core 36 is made of a magnetic material such as iron, and fixed in the housing 34 near or in the middle of the solenoid coil 35. The core 36 is symmetrically bisected with the same axis as that of the drive shaft 31 and the moving core 32. The moving core 32 can move close to and apart from the fixed core 36 to bring motion to the diaphragm 21. When the moving core 32 moves as close as possible to the fixed core 36, a small clearance remains between the facing surfaces of the moving core 32 and the fixed core 36. That is, a maximum amount of motion of the diaphragm 21 toward the fixed core 36 is set such that the moving core 32 does not directly contact the fixed core 36. Here, however, the fixed core 36 is not always necessary.

According to the double-acting diaphragm pump 1 of the first embodiment, the solenoid coil 35 is fixed inside the hermetic housing 34 of the actuator 33. When pulse voltage that is generated in a power source (not shown), and controlled by the ECU 19, is applied to the solenoid coil 35 through the terminal 20, the solenoid coil 35 and the fixed core 36 intermittently become electromagnets. With the magnetization, the moving core 32 is intermittently pulled into the solenoid coil 35. When the pulling force disappears, the moving core 32 is restored to a stationary position by resiliency of the diaphragm 21. In order to increase the restoring force of the diaphragm 21, a compression spring for biasing the diaphragm 21 away from the fixed core 36 can be provided in the second pump chamber 23. In this way, the diaphragm 21 reciprocates between the first chamber 22 and the second chamber 23. Therefore, while volumes in the first pump chamber 22 and the second pump chamber 23 are repeatedly, reciprocally increased and decreased, fluid in the purge pipe 8 is unilaterally fed into the purge pipe 12 by operation of the check valves 25 and 26, as the inlet valves, and the check valves 28 and 29, as the delivery valves. Since this diaphragm pump 1 is a double-acting type, a discharging amount becomes substantially double as compared with a general (non double-acting type) diaphragm pump. Therefore, it is possible to reduce a size of the pump 1.

In the evaporative emission control apparatus of the first embodiment shown in FIG. 2, similar to a general device, fuel vapor generated in the fuel tank 4 flows into the canister 2 from the fuel vapor intake port 2*b*. Then, the fuel vapor is temporarily adsorbed by the adsorbent 2*a*. Therefore, the fuel vapor causing air pollution is not released to the atmosphere. When the predetermined purge requirement is reached during operation of the internal combustion engine 3, the electric power supply into the diaphragm pump 1 is started by an instruction of the ECU 19. In the first embodiment, the pulse voltage is applied to the solenoid coil 35. At this time, the open/close valve 6 is open.

Accordingly, the double-acting diaphragm pump 1 compressively feeds air and the like in the pump chambers 22 and 23 from the purge pipe 8 toward the purge pipe 12. At this time, since pressure in the purge pipe 8 and the canister 2 is negative (a vacuum state), outside air is drawn into the canister 2 through the air pipe 7, the open/close valve 6 and the air intake port 2*c*. Further the sucked air passes through the adsorbent 2*b* and flows into the purge pipe 8 from the purge port 2*d*. Fuel vapor adsorbed with the adsorbent 2*a* is removed from the adsorbent 2*b* by this air flow. Then, the fuel vapor passes through the pump 1 with the air flow and is drawn into the air intake pipe 13 of the internal combustion engine 3 through the purge pipe 12. Further, this fuel vapor is combusted with general intake air and fuel in a combustion chamber of the engine 3.

In the double-acting diaphragm pump 1 of the first embodiment, the solenoid coil 35, the fixed core 36, the moving core 32 and the like of the actuator 33 are all disposed in the housing 34 which is hermetically integrated with the pump body 10. That is, nothing within those parts is communicated to the outside. Further, a sealing device having a slide-contacting surface and the like to potentially cause abrasion is not provided. Therefore, purged air including the fuel vapor is prevented from leaking outside of the pump chambers 22 and 23. Even if the diaphragm 21 is damaged and has a hole due to an extend period of use, only pumping action of the pump 1 will diminish, and the fuel vapor will not leak out. Accordingly, the fuel vapor is not wasted and it is effectively utilized.

Since the electric power supplied to the solenoid coil 35 is controlled by the ECU 19, magnitude of the voltage or the current applied to the solenoid coil 35 is adjusted, and frequency of the pulse is changed. Therefore, the discharging volume per unit time by the double-acting diaphragm pump 1 is freely controlled. Accordingly, it is possible to minimize power consumption of the pump 1, and as a result, durability of the diaphragm 21 and accompanying parts are increased. Here, the pump 1 is not only used with the evaporative emission control apparatus shown in FIG. 2, but also used as a pump in an evaporative emission control apparatus having a different system which will be described later.

Second Embodiment

Figure 3:
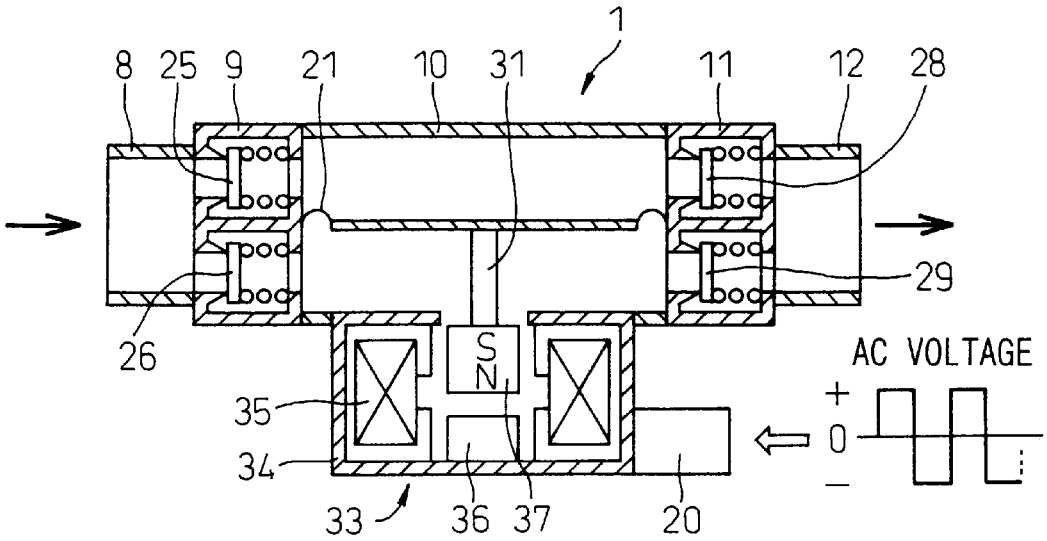
FIG. 3 is a cross-sectional view of a diaphragm pump of a second embodiment of the present invention.

A second embodiment is described with reference to FIG. 3. In the second embodiment, a structure in the actuator 33 is different from that of the first embodiment. A permanent magnet made of a ferromagnetic material is used as a moving core 37 in place of the moving core 32 made of the general magnetic material. Further, AC power, in which current direction alternates, is supplied into the terminal 20 of the solenoid coil 35 in place of the pulse power. Accordingly, the solenoid coil 35 can increase the force for "pushing" and "pulling," that is, moving, the moving core 37. Further, a lifting amount (height) of the diaphragm 21 is readily increased.

In this way, the double-acting diaphragm pump 1 of the second embodiment will exhibit a high degree of pumping performance. Here, a system of the evaporative emission control apparatus is similar to that of the first embodiment. The discharge amount is controlled by the ECU 19, and also in the second embodiment, the discharge amount, that is, the purging amount of the fuel vapor is freely controlled with the change of any one of the magnitudes of the AC power (current and frequency). Other functions and advantages are similar to those of the first embodiment.

Third Embodiment

Figure 4A:
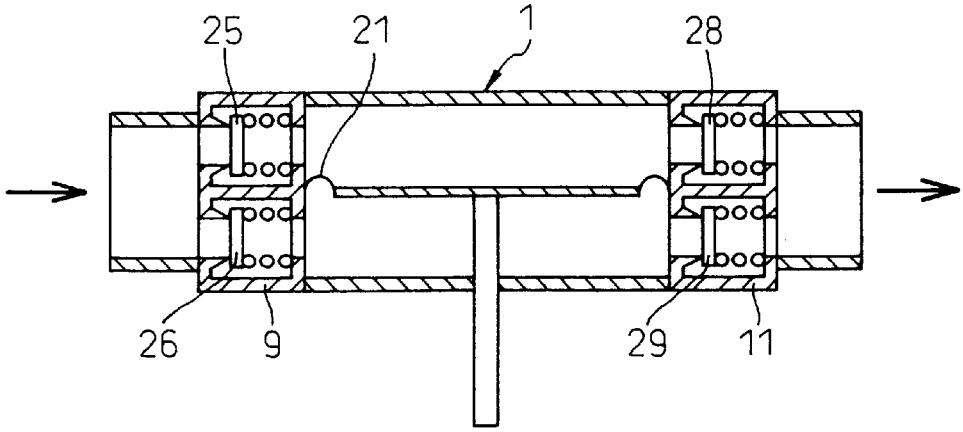
FIG. 4A is a cross-sectional view of a diaphragm pump of a third embodiment of the present invention.
Figure 4B:
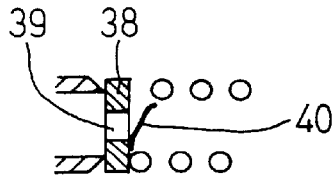
FIG. 4B is a cross-sectional view of reed-type check valve used in embodiments of the present invention.

A third embodiment is described hereinafter with reference to FIGS. 4A, 4B and 5. As shown in the valve of FIG. 4B, valve reeds 40 are provided on valve plates 38 of intake check valve 25 and intake check valve 26 in the inlet port 9 and the check valves 28 and 29 as the delivery valves in the outlet port 11. Each of the valve reeds 40 is made of thin spring steel plate, or the like. An end of the valve reed 40 is spot-welded, or the like, on each of the valve plates 38.

The valve reed 40 is attached so as to cover and uncover a hole 39 formed on the valve plate 38. In a state that the valve plate 38 is biased by the spring and closes the hole 39, the valve reed 40 functions as a small check valve automatically opening and closing the hole 39 by a pressure difference between an upstream side and a downstream side of the valve plate 38. The valve reed 40 is manufactured with a slight but permanent camber. Therefore, in a state that the operation of the pump 1 stops and when no pressure difference exists between the upstream and downstream sides of the valve reed 40, the hole 39 is uncovered a predetermined amount so as to not be fully closed. Therefore, fluid can flow toward the upstream side or the downstream side through the pump 1 while the pump 1 is stopped, and there is no pressure differential or very little pressure differential. In this way, the pump 1 fluidly communicates and ensures the leak-tightness of the entire system of the evaporative emission control apparatus including the canister 2, as described later.

Further in the third embodiment, the hole 39 is provided in each of the valve plates 38 which is a valve body of the check valve. The small valve reed 40 is provided in the valve plate 38 so that the pump 1 fluidly and internally communicates while the operation of the pump 1 is stopped. As a modified embodiment, slightly larger and curved reed valves (not shown) can be used in place of the valve plates 38. In this case, entire portions or portions of the check valves 25 and 26 as the intake valves and the check valves 28 and 29 as the delivery valves function as reed valves. In this case, the inlet port is preferably formed into a hole-like shape opening on a flat plate. The internal communication state of the pump 1 can be maintained while the pump is stopped by setting the valve reed to be slightly open a predetermined amount in a state where no pressure difference exists between the upstream and the downstream sides of the valve reed.

Figure 5:
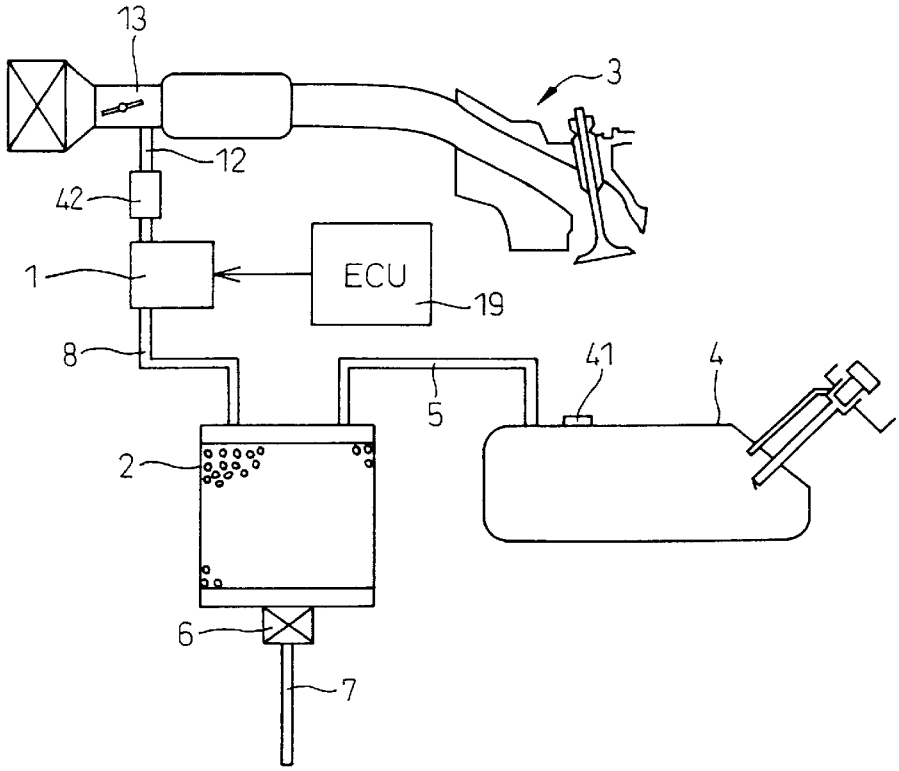
FIG. 5 is a diagram of a structural view of an evaporative emission control apparatus of a third embodiment of the present invention.

The leak-proof state of the entire system of the evaporative emission control apparatus is tested as shown in FIG. 5. The canister open/close valve 6 is provided on the air pipe 7 for introducing air into the canister 2. The open/close valve 6 is generally a check-type valve which automatically closes when the pressure in the canister 2 becomes negative, that is, when the canister is under a vacuum condition. In the present embodiment, however, an electromagnetic valve is used as the open/close valve 6 to be opened/closed by the ECU 19.

Similar to a general device, a purge control valve 42 is provided on the purge pipe 12 which connects the canister 2 and the air intake pipe 13 of the internal combustion engine 3. The purge control valve 42 can be manually opened/closed. Alternatively, the electromagnetic valve is used as the valve 42 to be operated by the ECU 19. When the negative pressure in the air intake pipe 13 in the engine 3 is large such as in a gasoline engine, the purge control valve 42 is usually provided at this position to select a time to purge the canister 2 and to control the purging amount. In the third embodiment of the present invention, however, the purge control valve 42 is used for interrupting the purge pipe 12 during the leak-tightness check, or leak-test.

In general, a pressure sensor 41 is provided to detect air pressure in an upper space in the fuel tank 4 and the spaces communicating with the upper space in the tank 4. In the third embodiment, the pressure sensor 41 is used for the leak check without providing an optional pressure sensor. The leak check is to test whether the fuel vapor leaks outside of the system of the apparatus including the canister 2, the fuel tank 4, the pump 1 and the like, or not. As shown in FIG. 5, the leak check can be automatically executed by a program in the ECU 19. It may also be manually executed.

When the leak check is executed, first, the open/close valve 6 on the air pipe 7 is closed. Next, the double-acting diaphragm pump 1 is operated so that the air pressure inside the fuel tank 4 and the canister 2 is decreased to the predetermined negative pressure. Then, the purge control valve 42 is closed. Therefore, the entire system of the evaporative emission control apparatus shown in FIG. 5 is sealed from the outside while keeping the negative pressure therein. At this time, since the inside of the pump 1 communicates by the function of the check valves as described above, the pump 1 is also checked. If any leaks exist in the system, the internal negative pressure becomes close to the atmospheric pressure due to entering of the outside air, and the change in pressure that it causes. Accordingly, the leak-tightness in the entire system is evaluated by measuring a time required for the pressure detected by the pressure sensor 41 to reach atmospheric pressure. Thus, any trouble in the system can be diagnosed. In the present evaporative emission control apparatus, it is possible to check leakages and pressure-related problems in the entire system by using the purge control valve 42, the pressure sensor 41, and the like. Therefore, it is unnecessary to provide an additional, optional system for the leak check and the like.

Fourth Embodiment

Figure 6:
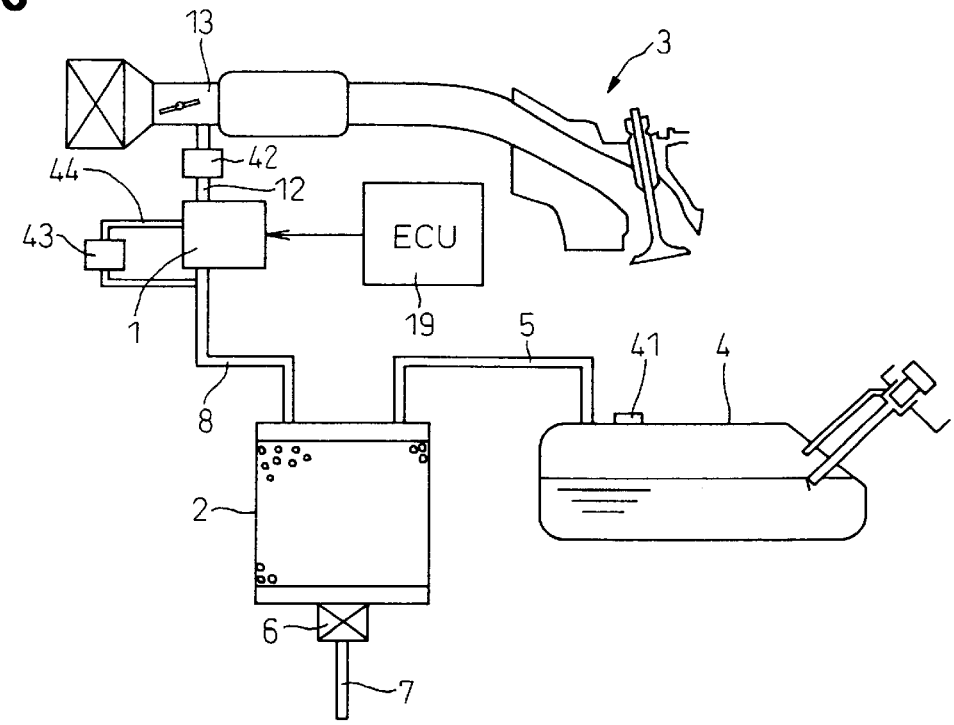
FIG. 6 is a diagram of a structural view of an evaporative emission control apparatus of a fourth embodiment of the present invention.

In a fourth embodiment shown in FIG. 6, the pump 1, similar to that of the first and the second embodiments, is used, so the pump 1 does not have an inside communicated state. Here, in order to test the leak-tightness, a bypass pipe 44 is provided to connect the purge pipe 8 and at least one of the pump chambers 22 and 23 of the pump 1. Also, a bypass valve 43 is inserted in the bypass pipe 44. In a case that two bypass pipes 44 are provided, each bypass pipe 44 has the bypass valve 43. The bypass valve 43 can be manually operated. Alternatively, the electromagnetic valve can be used as the valve 43 to be controlled by the ECU 19.

When the leak-tightness test is executed, the purge control valve 42 is closed and the bypass valve 43 is opened after the pressure decreases. Therefore, the air pressure in the pump 1 can be detected by the pressure sensor 41 in the fuel tank 4, and as a result, leakage in the whole system including the pump 1 can be checked. In a case that the bypass pipe 44 is provided to one of the pump chambers 22 and 23, the air pressure in the chamber where the bypass pipe is not provided can be equalized to that in the chamber by providing the bypass pipe 44 through the diaphragm 21, so the leak-tightness is checked in both chambers. However, it is preferable to provide the bypass pipes 44 and the bypass valves 43 on both of the chambers 22 and 23. Accordingly, also in the fourth embodiment, it is possible to test the leak-tightness in the system by using the open/close valve 6, the purge control valve 42 and the pressure sensor 41. In this way, the pressure within the system may be readily diagnosed.

Fifth Embodiment

Figure 7:
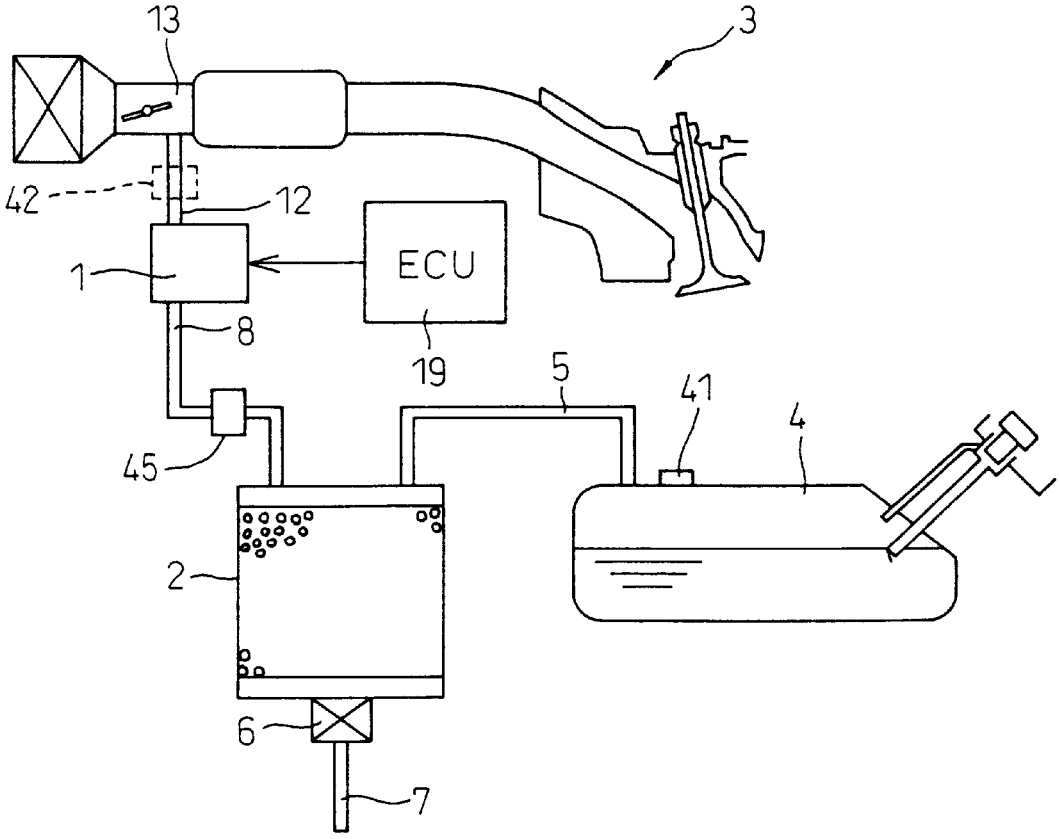
FIG. 7 is a diagram of a structural view of an evaporative emission control apparatus of a fifth embodiment of the present invention.

As shown in FIG. 7, a fifth embodiment provides an open/close valve 45 such as the electromagnetic valve in the purge pipe 8. For example, leakage in the canister 2 and the fuel tank 4 other than the pump 1 can be checked based on the pressure detected by the pressure sensor 41 in a state that the open/close valve 45 is closed. In this state, when the purge control valve 42 is opened and the pump 1 is operated, the pump 1 works as a vacuum pump. At this time, if the electric current flowing in the solenoid coil 35 is smaller than a predetermined current which is measured in a normal pumping state beforehand, leakage is detected in the pump 1. Similar to this, in the state that the open/close valve 45 is open, the leakage in the canister 2 and the fuel tank 4 can also be checked. Here, the purge control valve 42 is not always necessary. Also, the open/close valve 45 can be used in place of the purge control valve 42.

While the present evaporative emission control apparatus is operated to purge fuel vapor, the following relationships are found between various factors indicating operation states of the pump 1 and the engine 3, as shown in FIGS. 8A to 8E. Although each case may not always have proportional relationships (simple straight lines), each case shows a combination of two factors in which one factor is increased in accordance with an increase in the other factor.

Figure 8A:
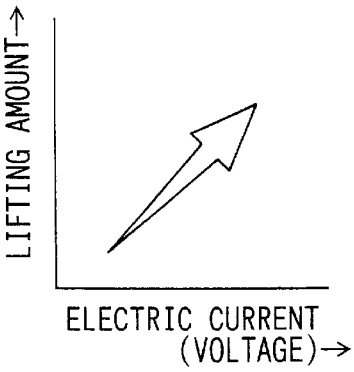
FIG. 8A is a graph showing a relationship between diaphragm lifting amount and electric current in a solenoid when controlling the evaporative emission control apparatus of an embodiment of the present invention.
Figure 8B:
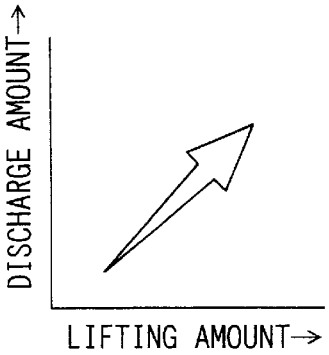
FIG. 8B is a graph showing a relationship between pump discharge amount and diaphragm lifting amount when controlling the evaporative emission control apparatus of an embodiment of the present invention.
Figure 8C:
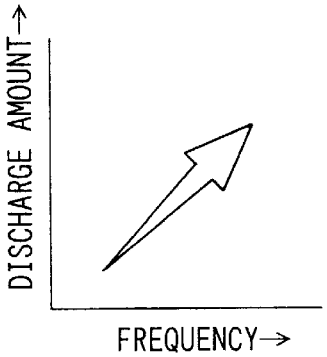
FIG. 8C is a graph showing a relationship between pump discharge amount and the electrical frequency of the electric power supplied to the solenoid coil when controlling the evaporative emission control apparatus of an embodiment of the present invention.

First, as shown in FIG. 8A, when the electric current/voltage flowing in the solenoid coil 35 in the actuator 33 of the pump 1 is increased, a lifting amount of the diaphragm 21, that is, a stroke of the moving core 32 is also increased. As shown in FIG. 8B, when the lifting amount of the diaphragm 21 is increased, a flowing amount, that is, a discharge amount of the pump 1 is also increased. Similar to this, when frequency of the electric power supplied to the solenoid coil 35 is increased, the discharge/flow amount of the pump 1 is increased, as shown in FIG. 8C.

Figure 8D:
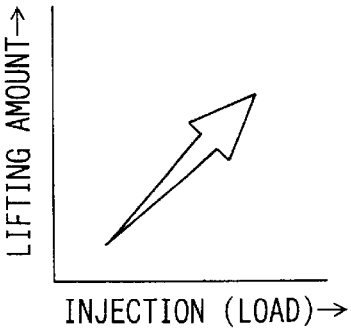
FIG. 8D is a graph showing a relationship between diaphragm lifting amount and fuel injection amount of the engine (load) when controlling the evaporative emission control apparatus of an embodiment of the present invention.
Figure 8E:
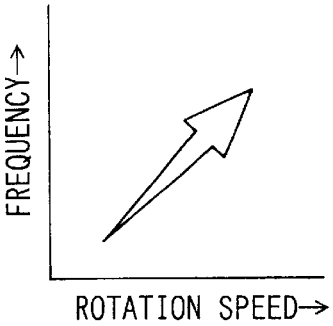
FIG. 8E is a graph showing a relationship between electrical frequency of the electric power supplied to the solenoid coil and rotational speed of the engine when controlling the evaporative emission control apparatus of an embodiment of the present invention.

From another point of view, in a state where rotational speed of the engine 3 is increased and the engine output is high, the operational state of the engine 3 is not largely changed due to the fuel vapor flowing into the air intake pipe 13 from the evaporative emission control apparatus through the purge pipe 12. Therefore, it is unnecessary to sensitively control the engine 3 in response to an amount of the purged fuel vapor. Accordingly, in this state, the engine 3 can treat a large amount of purged fuel removed from the canister 2. Therefore, as shown in FIG. 8D, it is possible to increase the discharge amount of the pump 1 by increasing the lifting amount of the diaphragm 1, that is, the stroke of the moving core 32, in accordance with the increase in the fuel injection amount of the engine 3, that is, the load. Also, with reference to FIG. 8E, when the rotational speed of the engine 3 is increased, since it is possible to increase the discharge amount of the pump 1, the frequency of the electric power supplied to the solenoid coil 35 can be increased. The above-described relationships can be stored in the form of a data map or information map in memory or ROM of the ECU 19, to be used in purge control of the evaporative emission control apparatus.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An evaporative emission control apparatus comprising:

a fuel vapor adsorbing means connected to a fuel vapor generating source, the fuel vapor adsorbing means for storing adsorbent and for temporarily adsorbing fuel vapor;

a fuel vapor treating means for treating the fuel vapor removed from the fuel vapor adsorbing means; and a drawing means provided on a purge pipe that connects the fuel vapor adsorbing means and the fuel vapor treating means, for drawing air though the fuel vapor adsorbing means to forcedly remove fuel vapor from the adsorbent and feed the fuel vapor into the fuel vapor treating means, wherein the drawing means has a double-acting diaphragm pump that includes a first pump chamber and a second pump chamber, one on each side of a diaphragm to draw fuel vapor.

2. The evaporative emission control apparatus according to claim 1, wherein the fuel vapor treating means has a combustion chamber of an internal combustion engine; and wherein an end of the purge pipe is connected to an air intake pipe of the internal combustion engine.

3. The evaporative emission control apparatus according to claim 2, wherein the double-acting diaphragm pump provides, as a diaphragm actuating means, a housing hermetically integrated with the diaphragm pump, a moving core provided in the housing and attached to the diaphragm, and a solenoid coil provided in the housing and for reciprocating the moving core by electromagnetic force that is generated and changed by electric power having AC voltage or pulse voltage.

4. The evaporative emission control apparatus according to claim 3, wherein a discharging amount per unit time of the double-acting diaphragm pump is changed by controlling at least one of a voltage, a current and a frequency supplied to the solenoid coil, and a purging amount of fuel vapor purged from the fuel vapor adsorbing means is controlled with the change of the discharge amount.

5. The evaporative emission control apparatus according to claim 4, wherein the moving core is made of a permanent magnet.

6. The evaporative emission control apparatus according to claim 5, wherein each of the pump chambers has a check valve at least in one of an inlet port and an outlet port thereof, the check valve being automatically opened and closed by a pressure difference between an upstream side and a downstream side of the pump chamber.

7. The evaporative emission control apparatus according to claim 6, wherein the check valve is a reed valve.

8. The evaporative emission control apparatus according to claim 7, wherein the check valve is arranged to be open during an absence of the pressure difference between the upstream side and the downstream side when a pumping operation is stopped.

9. The evaporative emission control apparatus according to claim 8, further comprising:

a first open/close valve provided on a purge pipe connecting the double-acting diaphragm pump and the fuel vapor adsorbing means.

10. The evaporative emission control apparatus according to claim 9, further comprising:

a second open/close valve provided at an air intake side of the fuel vapor adsorbing means; and a pressure detecting means that detects air pressure in the fuel vapor adsorbing means, the fuel vapor generating source being connected to the fuel vapor adsorbing means, and the double-acting diaphragm pump.

11. The evaporative emission control apparatus according to claim 3, wherein the moving core is made of a permanent magnet.

12. The evaporative emission control apparatus according to claim 11, wherein each of the pump chambers has a check valve at least in one of an inlet port and an outlet port thereof, the check valve being automatically opened and closed by a pressure difference between an upstream side and a downstream side of the pump chamber.

13. The evaporative emission control apparatus according to claim 12, wherein the check valve is a reed valve.

14. The evaporative emission control apparatus according to claim 13, wherein the check valve is arranged to be open during an absence of the pressure difference between the upstream side and the downstream side when a pumping operation is stopped.

15. The evaporative emission control apparatus according to claim 14, further comprising:

a first open/close valve provided on a purge pipe connecting the double-acting diaphragm pump and the fuel vapor adsorbing means.

16. The evaporative emission control apparatus according to claim 15, further comprising:

a second open/close valve provided at an air intake side of the fuel vapor adsorbing means; and a pressure detecting means that detects air pressure in the fuel vapor adsorbing means, the fuel vapor generating source being connected to the fuel vapor adsorbing means, and the double-acting diaphragm pump.

17. The evaporative emission control apparatus according to claim 1, wherein each of the pump chambers has a check valve at least in one of an inlet port and an outlet port thereof, the check valve being automatically opened and closed by a pressure difference between an upstream side and a downstream side of the pump chamber.

18. The evaporative emission control apparatus according to claim 17, wherein the check valve is a reed valve.

19. The evaporative emission control apparatus according to claim 18, wherein the check valve is arranged to be open during an absence of the pressure difference between the upstream side and the downstream side when a pumping operation is stopped.

20. The evaporative emission control apparatus according to claim 19, further comprising:

a first open/close valve provided on a purge pipe connecting the double-acting diaphragm pump and the fuel vapor adsorbing means.

21. The evaporative emission control apparatus according to claim 20, further comprising:

a second open/close valve provided at an air intake side of the fuel vapor adsorbing means; and a pressure detecting means that detects air pressure in the fuel vapor adsorbing means, the fuel vapor generating source connected to the fuel vapor adsorbing means, and the double-acting diaphragm pump.

22. An evaporative emission control apparatus comprising:

a fuel vapor adsorbing means connected to a fuel vapor generating source, the fuel vapor adsorbing means for storing adsorbent and for temporarily adsorbing fuel vapor;

a fuel vapor treating means for treating the fuel vapor removed from the fuel vapor adsorbing means; and a drawing means provided on a purge pipe that connects the fuel vapor adsorbing means and the fuel vapor treating means, for drawing air through the fuel vapor adsorbing means to forcedly remove fuel vapor from the adsorbent and feed the fuel vapor into the fuel vapor treating means, wherein the drawing means has a diaphragm pump with a chamber to draw fuel vapor;

wherein the diaphragm pump provides, as a diaphragm actuating means, a housing hermetically integrated with the diaphragm pump, a moving core provided in the housing and attached to the diaphragm, and a solenoid coil provided in the housing and for reciprocating the moving core by electromagnetic force that is generated and changed by electric power having AC voltage or pulse voltage; and the chamber is continuously compressed by every back and forth motion of the movable core thereby continuously drawing the fuel vapor.

23. The evaporative emission control apparatus according to claim 22, wherein the fuel vapor treating means has a combustion chamber of an internal combustion engine; and wherein an end of the purge pipe is connected to an air intake pipe of the internal combustion engine.

24. The evaporative emission control apparatus according to claim 22, wherein a discharging amount per unit time of the diaphragm pump is changed by controlling at least one of a voltage, a current and a frequency supplied to the solenoid coil, and a purging amount of fuel vapor purged from the fuel vapor adsorbing means is controlled with the change of the discharge amount.

25. The evaporative emission control apparatus according to claim 24, wherein the moving core is made of a permanent magnet.

26. The evaporative emission control apparatus according to claim 25, wherein the pump chamber has a check valve at least in one of an inlet port and an outlet port thereof, the check valve being automatically opened and closed by a pressure difference between an upstream side and a downstream side of the pump chamber.

27. The evaporative emission control apparatus according to claim 26, wherein the check valve is a reed valve.

28. The evaporative emission control apparatus according to claim 27, wherein the check valve is arranged to be open during an absence of the pressure difference between the upstream side and the downstream side when a pumping operation is stopped.

29. The evaporative emission control apparatus according to claim 28, further comprising:

a first open/close valve provided on a purge pipe connecting the diaphragm pump and the fuel vapor adsorbing means.

30. The evaporative emission control apparatus according to claim 29, further comprising:

a second open/close valve provided at an air intake side of the fuel vapor adsorbing means; and a pressure detecting means that detects air pressure in the fuel vapor adsorbing means, the fuel vapor generating source connected to the fuel vapor adsorbing means, and the diaphragm pump.

31. An evaporative emission control apparatus comprising:

a fuel vapor adsorbing means connected to a fuel vapor generating source, the fuel vapor adsorbing means for storing adsorbent and for temporarily adsorbing fuel vapor;

a fuel vapor treating means for treating the fuel vapor removed from the fuel vapor adsorbing means; and a drawing means provided on a purge pipe that connects the fuel vapor adsorbing means and the fuel vapor treating means, for drawing air through the fuel vapor adsorbing means to forcedly remove fuel vapor from the adsorbent and feed the fuel vapor into the fuel vapor treating means, wherein the drawing means has a double-acting diaphragm pump that includes a first pump chamber and a second pump chamber, one on each side of a diaphragm to draw fuel vapor, the first and second pump chambers forming a parallel passage to an intake pipe and wherein the first and second pump chambers are alternately compressed by reciprocation of the diaphragm to thereby continuously draw the fuel vapor through the parallel passage.

32. An apparatus comprising:

a container connected to a fuel vapor generating source, the container storing adsorbent for temporarily adsorbing fuel vapor;

an intake pipe of an internal combustion engine; and a double-acting diaphragm pump, provided on a purge pipe that connects the container and the intake pipe, for drawing air through the container to forcedly remove fuel vapor from the adsorbent and feed the fuel vapor into the intake pipe, wherein the double-acting diaphragm pump includes a first pump chamber and a second pump chamber, one on each side of a diaphragm to draw fuel vapor.

33. The evaporative emission control apparatus according to claim 32, wherein the first and second pump chambers form a parallel passage to the intake pipe, and the first and second pump chambers are alternately compressed by reciprocation of the diaphragm to thereby continuously draw the fuel vapor through the parallel passage.

34. An apparatus comprising:

a container connected to a fuel vapor generating source, the container storing adsorbent for temporarily adsorbing fuel vapor;

an intake pipe of an internal combustion engine;

a diaphragm pump, provided on a purge pipe that connects the container and the intake pipe, for drawing air through the container to forcedly remove fuel vapor from the adsorbent and feed the fuel vapor into the intake pipe, wherein the diaphragm pump includes a chamber to draw fuel vapor, a housing hermetically integrated with the diaphragm pump;

a moving core provided in the housing and attached to the diaphragm; and a solenoid coil provided in the housing for reciprocating the moving core by electromagnetic force that is generated and changed by electric power having AC voltage or pulse voltage;

wherein the chamber is continuously compressed by every back and forth motion of the movable core thereby continuously drawing the fuel vapor.

* * * * *